United States Patent [19]

Miyoshi et al.

[11] Patent Number: 4,851,056

[45] Date of Patent: Jul. 25, 1989

[54] PROCESS FOR PRODUCING A SEMI-PROCESSED NON-ORIENTED ELECTRICAL STEEL SHEET HAVING A LOW WATT LOSS AND A HIGH MAGNETIC FLUX DENSITY

[75] Inventors: Kunisuke Miyoshi; Yoshiaki Shimoyama; Takeshi Kubota, all of Kitakyushu, Japan

[73] Assignee: Nippon Steel Corporation, Tokyo, Japan

[21] Appl. No.: 55,297

[22] Filed: May 29, 1987

[30] Foreign Application Priority Data

Dec. 28, 1981 [JP] Japan ..... 56-213368

[51] Int. Cl.[4] ..... H01F 1/04

[52] U.S. Cl. ..... 148/111; 148/120

[58] Field of Search ..... 148/111, 120

[56] References Cited

U.S. PATENT DOCUMENTS

| | | | |
|---|---|---|---|
| 3,162,554 | 12/1964 | Frischmann et al. | 148/111 |
| 3,867,211 | 2/1975 | Easton | 148/120 |
| 3,988,177 | 10/1976 | Ecker et al. | 148/111 |
| 4,204,890 | 5/1980 | Irie et al. | 148/111 |
| 4,306,922 | 12/1981 | Coombs et al. | 148/111 |

FOREIGN PATENT DOCUMENTS

| | | | |
|---|---|---|---|
| 1966686 | 8/1973 | Fed. Rep. of Germany | 148/121 |
| 50-67217 | 6/1975 | Japan . | |
| 50-75916 | 6/1975 | Japan . | |
| 53-66816 | 6/1978 | Japan . | |
| 55-100927 | 1/1980 | Japan . | |
| 56-98420 | 4/1981 | Japan . | |
| 56-38420 | 7/1981 | Japan . | |

OTHER PUBLICATIONS

Hu et al, "Effects of Carbon and Manganese on the Recrystallization Texture of Cold Rolled Low Carbon Steel Sheet", 3057 (Nov. 1970).

Ohashi et al, "Effects of Carbon and Manganese on the Recrystallization Texture of Cold Rolled Low Carbon Steel Sheet", Apr. 1973.

"Standard Methods for Estimating the Average Grain Size of Metals", ASTM, Designation E 112–63, pp. 420–433 (Reapproved 1969).

*Primary Examiner*—John P. Sheehan

*Attorney, Agent, or Firm*—Cushman, Darby & Cushman

[57] ABSTRACT

In a conventional process for producing a semi-processed non-oriented electrical steel sheet, the silicon or aluminum content of a hot-rolled steel strip is high, especially in the case of producing a high-grade electrical sheet which has a low watt loss. However, a high silicon or aluminum content disadvantageously results in a decrease in the magnetic flux density.

A decrease in the watt loss and an increase in the magnetic flux density in semi-processed non-oriented electrical steel sheets as compared with conventional high-grade semi-processed non-oriented electrical steel sheets can be achieved by making the silicon content, which increases resistivity, low, i.e. from 0.1 to 1.0%, and the manganese content, which is effective for improving the texture, high i.e. from 0.75 to 1.5% and by subjecting the starting material, having a low silicon content, and a high manganese content to an appropriate production process for controlling texture.

6 Claims, 1 Drawing Sheet

Figure 1:
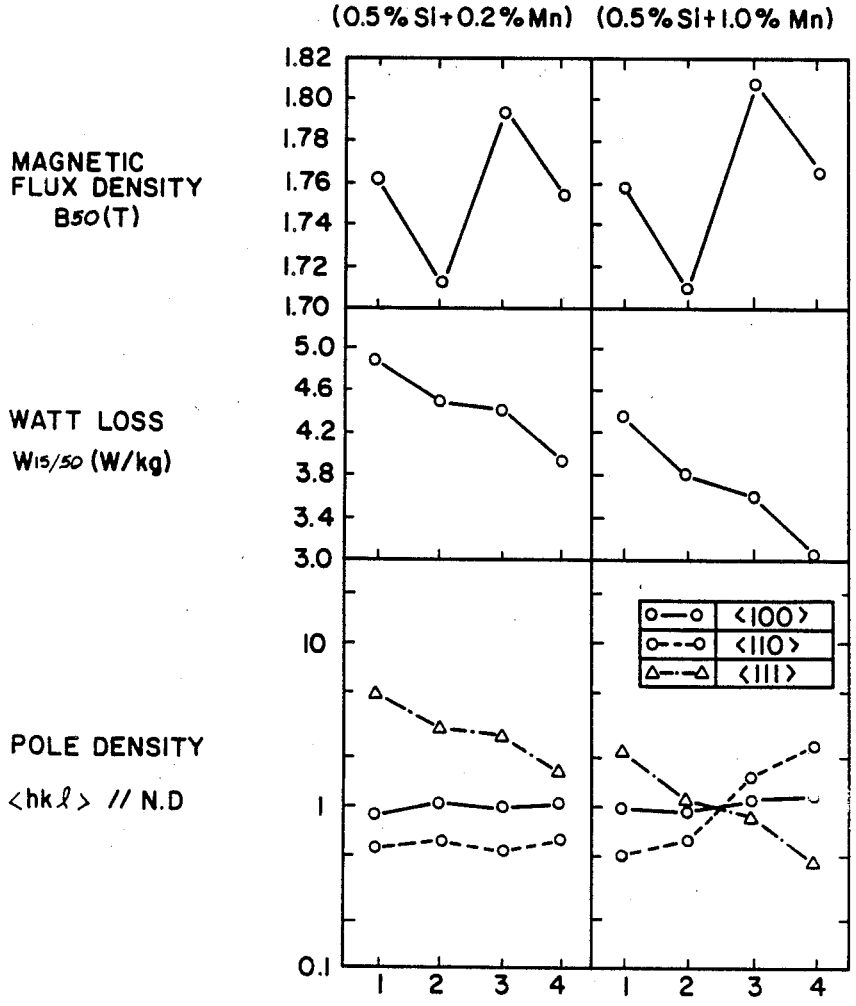

1- COLD ROLLING
2-COLD ROLLING-INTERMEDIATE ANNEALING-SKINPASSING
3-ANNEALING-COLD ROLLING
4-ANNEALING-COLD ROLLING-INTERMEDIATE ANNEALING-SKINPASSING

PROCESS FOR PRODUCING A SEMI-PROCESSED NON-ORIENTED ELECTRICAL STEEL SHEET HAVING A LOW WATT LOSS AND A HIGH MAGNETIC FLUX DENSITY

The present invention relates to a process for producing a semi-processed non-oriented electrical steel sheet having a low watt loss and a high magnetic flux density, which sheet is used as core material for electrical machinery and apparatuses.

Recently, the demands for electrical machinery and apparatuses having enhanced characteristics have been increasing since, internationally, industry has been attempting to reduce electric power consumption, and energy consumption in general.

Especially, energetic attempts have made to reduce electric power consumption in such electrical machinery and apparatuses as rotary machines, which are continually operated, so as to increase the efficiency of such machines. In respect to this, a low watt loss and a high magnetic flux density of the core material is indispensable for reducing electric power and energy consumption in electrical machinery and apparatuses. In conventional high-grade semi-processed non-oriented electrical sheets, the content of silicon or aluminum which appreciably increases resistivity and thus descreases eddy-current loss, is high so as to decrease the watt loss. However, a high silicon or aluminum content disadvantageously results in a decrease in the magnetic flux density.

It is an objectof the present invention to provide a process for producing a semi-processed non-oriented electrical sheet, in which process the watt loss is decreased without the magnetic flux density being decreased.

According to a discovery made by the present inventors, a decrease in the watt loss and an increase in the magnetic flux density in semi-processed non-oriented electrical steel sheets as compared with conventional high-grade semi-processed non-oriented electrical steel sheets can be achieved by making the silicon content, which appreciably increases resistivity, low and the manganese content, which is effective for improving the texture, high and by subjecting the starting material, having a low silicon content and a high manganese content, to an appropriate production process for controlling the texture. That is, when a steel having a low silicon content and a high manganese content is subjected to an appropriate production process, the texture of the semi-processed non-oriented electrical steel sheet can be advantageously controlled, and thereby the magnetic properties can be enhanced. The present invention was completed based on this discovery.

One process for producing a semi-processed non-oriented electrical steel sheet having a low watt loss and a high magnetic flux density, according to the present invention, comprises the steps of:

forming a hot-rolled steel strip containing, in weight percent, not more than 0.005% carbon, from 0.1% to 1.0% silicon, and from 0.75% to 1.5% manganese, the balance being iron and unavoidable impurities, including 0.005% sulfur at the highest;

annealing the hot-rolled steel strip, if necessary, at a temperature of from 750° C. to 850° C. for at least 2 minutes;

directly subjecting the hot-rolled steel strip to pickling after hot-rolling or annealing;

subjecting the pickled steel strip to either single cold-rolling or to cold-rolling followed by intermediate annealing and skin pass rolling, thereby obtaining a final thickness.

Another process for producing a semi-processed non-oriented electrical steel sheet having a low watt loss and a high magnetic flux density comprises the steps of:

forming a hot-rolled steel strip containing, in weight percent, not more than 0.005% carbon, from 0.1% to 1.0% silicon, from 0.75% to 1.5% manganese, and from 0.1% to 0.3% aluminum, the balance being iron and unavoidable impurities, including 0.005% sulfur at the highest;

annealing the hot-rolled steel strip, if necessary, at a temperature of from 750° C. to 850° C. for at least 2 minutes, directly subjecting the hot rolled steel strip to pickling after hot-rolling or annealing;

subjecting the pickled steel strip to either single cold-rolling or cold-rolling followed by intermediate annealing and skin pass rolling, thereby obtaining a final thickness.

A further process for producing a semi-processing non-oriented electrical steel sheet having a low watt loss and a high magnetic flux density comprises the steps of:

forming a hot-rolled steel strip containing, in weight percent, not more than 0.005% carbon, from 0.1% to 1.0% silicon, from 0.75% to 1.5% manganese, less than 0.1% aluminum, 0.7 to 1.2 times as much nitrogen as boron (N/B=0.7–1.2), the balance being iron and unavoidable impurities including 0.005% sulfur at the highest;

annealing the hot-rolled steel strip, if necessary, at a temperature of from 750° C. to 850° C. for at least 2 minutes, directly subjecting the hot-rolled steel strip to a pickling after hot-rolling or annealing;

subjecting the pickled steel strip to either single cold-rolling or to cold-rolling followed by intermediate annealing and skin pass rolling, thereby obtaining a final thickness.

The hot-rolled steel strip may further contain from 0.05% to 0.15% phosphorus.

Conventionally, manganese is not used to enhance the magnetic properties of an electrical steel sheet because manganese is liable to form nonmetallic inclusions, such as sulfides and oxides. However, it is possible to use manganese to enhance the magnetic properties of an electrical steel sheet if the steelmaking technique is advanced enough so that high-purity steels can be produced. Therefore, the present inventors made researches into mainly recrystallization and texture and determined the production conditions, such as the manganese content of a hot-rolled steel strip, etc., necessary for developing [100] and [110] textures, which textures result in desirable magnetic properties, and for suppressing a [111] texture, which texture is detrimental to the magnetic properties.

The present invention is hereinafter described with reference to the FIGURE.

The FIGURE illustrates the magnetic non properties and texture of 0.5 mm-thick semi-processed non-oriented electrical steel sheets. These steel sheets were produced by subjecting hot-rolled steel sheets containing 0.2% or 1.0% manganese, as well as 0.5% silicon, to the following steps indicated in the FIGURE:

1. single cold-rolling 2. single cold-rolling, intermediate annealing, and skin pass rolling
3. annealing (i.e., hot-rolled strip annealing) and single cold-rolling
4. annealing (i.e., hot-rolled strip annealing), single cold-rolling, intermediate annealing, and skin pass-rolling The magnetic properties and the texture of the semi-processed non-oriented electrical steel sheets were investigated after the sheets were subjected to stress-relief annealing, which was carried out at a temperature of 750° C. for a period of 2 hours in a 100% $N_2$ dry atmosphere.

In the 0.5% Si+1.0% Mn semi-processed non-oriented electrical steel sheets, the watt loss $W_{15/50}$ was less than 4.5 W/kg when step 1, i.e., single cold-rolling, was carried out, was 3.8 W/kg when step 2, i.e., single cold-rolling, intermediate annealing, and skin pass rolling, was carried out, and was 3.0 W/kg when step 4, i.e., annealing, single cold-rolling, intermediate annealing, and skin pass rolling, was carried out.

In the 0.5% Si+1.0% Mn semi-processed non-oriented electrical steel sheets, the magnetic flux density $B_{50}$ was 1.76T when step 1, i.e., single cold-rolling, was carried out and was 1.76T when step 4, i.e., annealing, single cold-rolling, intermediate annealing, and skin pass rolling, was carried out. As these results show, a both low watt loss and a high magnetic flux density could be attained by means of the production processes of the present invention.

As is apparent from the above explanations, the magnetic properties of a semi-processed non-oriented electrical steel sheet depend on the production process. Therefore, producers can select a production process by which the magnetic properties required by customers can be obtained.

The composition of a hot-rolled steel sheet according to the present invention is hereinafter described.

A low carbon content is desirable for reducing the watt loss and for preventing deterioration of the magnetic properties due to aging which is induced after stress-relief annealing is carried out in a non-oxidizing atmosphere. The carbon content must be not more than 0.005% so as to prevent the deterioration of the magnetic properties mentioned above.

Silicon appreciably increases the resistivity and thus decreases the watt loss. When the silicon content is less than 0.1%, the silicon is not effective for decreasing the watt loss. When the silicon content is more than 1.0%, the magnetic flux density is low. When the magnetic properties of and the texture of the 0.5% Si+1.0% Mn is semi-processed non-oriented electrical steel sheets are composed with those of the 0.5% Si+0.2% Mn semi-processed non-oriented electrical steel sheets, it is apparent that manganese is effective for improving the texture and the magnetic properties. More specifically, the pole density <hkl>//N.D (Normal Direction) shown in the FIGURE clearly indicates that manganese contributes to developing [100] and [110] textures and to suppressing a [111] texture. When the manganese content is less than 0.75%, the manganese is not very effective for improving the texture and the magnetic properties.

In addition, manganese lowers the ferrite-austenite transformation temperature. Therefore, when the manganese content is more than 1.5%, ferrite-austenite transformation is likely to occur during the annealing or intermediate annealing of a hot-rolled strip, thereby rendering the manganese ineffective for improving the texture and the magnetic properties.

Sulfur may form nonmetallic inclusions, such as MnS, which are detrimental to the magnetic properties. If the sulfur content is more than 0.005%, it is impossible to stably attain effects due to manganese. In addition, a low sulfur content is advantageous for lowering the recrystallization temperature. Since the hot-rolled steel strip of the present invention contains from 0.75% to 1.5% manganese, the austenite-ferrite transformation temperature is lowered. Therefore, satisfactory recrystallization should occur at a relatively low temperature.

Aluminum appreciably increases the resistivity, as does silicon. Aluminum may be contained in the hot-rolled steel strip of the present invention so as to further reduce the watt loss. However, when the aluminum content is more than 0.3%, the magnetic flux density is low, and when the aluminum content is less than 0.1%, deterioration of the magnetic properties due to the precipitation of AlN may occur, necessitating the addition of boron in an amount 0.7 to 1.2 times the amount of nitrogen so as to prevent the deterioration.

Phosphorus may be contained in the hot-rolled steel strip of the present invention so as to further reduce the watt loss. When the phosphorus content is less than 0.05%, the phosphorus is not effective for reducing the watt loss. On the other hand, when the phosphorus content is more than 0.15%, the magnetic flux density is low.

Good magnetic properties can be obtained by cold-rolling an as hot-rolled steel strip having the chemical composition of the present invention.

Annealing of a hot-rolled steel strip having a high manganese content and a low silicon content can improve the texture of the strip, thereby enhancing the magnetic properties thereof as compared with those without annealing of a hot-rolled strip (c.f. step 1 and step 3 of the FIGURE). If the hot-rolled strip is annealed at a temperature less than 750° C., the annealing is not very effective for improving the texture of the strip. Since the hot-rolled steel strip contains from 0.75% to 1.5% manganese, ferrite-austenite transformation is induced at a temperature more than 850° C., thereby rendering the manganese ineffective for improving the texture and the magnetic properties. Therefore, the hot-rolled strip must be annealed at a temperature of not more than 850° C. If the hot-rolled strip is annealed for less than 2 minutes, the annealing is not effective for improving the texture of the strip. Annealing of the hot-rolled steel strip may be carried out by means of self-annealing in which the strip is annealed by the heat retained therein. The temperature and the period of time self-annealing are the same as those described hereinabove.

Skin pass rolling can further improve the texture. In order to reduce the watt loss by meaning of skin pass rolling to less than that attained only by cold-rolling, intermediate annealing must be carried out prior to skin pass rolling. The reduction rate (draft) at skin pass rolling depends on the intermediate annealing temperature. Preferably, reduction rate at skin pass rolling is from 5% to 7%. A reduction in watt loss due to the skin pass rolling and intermediate annealing is apparent from FIG. 1.

Conventional and unspecified installation may be used to carry out the process of the present invention. These installations are steel refining installations, such as a known converter, decarburizing installations, such as a known vacuum degassing and decarburizing installation, slab-producing installations, such as a known continuous casting machine for producing a strand and, steel-strip processing installations for carrying out hot-rolling, annealing of a hot-rolled steel strip, cold-rolling, skin pass rolling, and intermediate annealing.

The present invention is hereinafter explained with reference to the example.

EXAMPLE

Semi-processed non-oriented electrical sheets having a thickness of 0.5 mm were produced by using continuously cast slabs, the major elements of which are shown in the table below. The continuously cast slabs were hot-rolled, and the resultant hot-rolled strips were subjected to the production processes given in the table.

TABLE 1

| Steel No. | C [wt %] | Si [wt %] | Mn [wt %] | P [wt %] | S [wt %] | Al [wt %] | N [wt %] | B [wt %] | Annealing of a Hot-Rolled Strip | Skin Pass Rolling | Stress-Relief Annealing | Watt Loss $W_{15/50}$ [w/kg] | Magnetic Flux Density $B_{50}$[T] |
|---|---|---|---|---|---|---|---|---|---|---|---|---|---|
| 1 | 0.0034 | 1.91 | 0.23 | — | 0.002 | — | — | — | — | — | 750° C. × 2 hours $H_2$ 100% Dry Atmosphere | 3.72 | 1.66 |
| 2 | 0.0031 | 0.50 | 0.22 | — | 0.002 | — | — | — | — | — | " | 4.89 | 1.76 |
| 3 | | | | | | | | | — | — | " | 4.45 | 1.76 |
| 4 | | | | | | | | | — | 6% | " | 3.83 | 1.71 |
| | 0.0037 | 0.49 | 1.28 | — | 0.002 | — | — | — | | | | | |
| 5 | | | | | | | | | 800° C. × 2 minutes | — | " | 3.66 | 1.81 |
| 6 | | | | | | | | | 800° C. × 2 minutes | 6% | " | 3.08 | 1.77 |
| 7 | | | | | | | | | — | — | " | 4.23 | 1.74 |
| 8 | | | | | | | | | — | 6% | " | 3.69 | 1.70 |
| | 0.0033 | 0.50 | 1.19 | — | 0.003 | 0.24 | — | — | | | | | |
| 9 | | | | | | | | | 800° C. × 2 minutes | — | " | 3.58 | 1.79 |
| 10 | | | | | | | | | 800° C. × 2 minutes | 6% | " | 3.01 | 1.76 |
| 11 | | | | | | | | | — | — | " | 4.31 | 1.75 |
| 12 | | | | | | | | | — | 6% | " | 3.73 | 1.70 |
| | 0.0029 | 0.53 | 1.16 | — | 0.003 | 0.073 | 0.0028 | 0.0026 | | | | | |
| 13 | | | | | | | | | 800° C. × 2 minutes | — | " | 3.60 | 1.79 |
| 14 | | | | | | | | | 800° C. × 2 minutes | 6% | " | 3.03 | 1.76 |
| 15 | | | | | | | | | — | — | " | 4.33 | 1.75 |
| 16 | | | | | | | | | — | 6% | " | 3.70 | 1.70 |
| | 0.0035 | 0.51 | 1.33 | 0.11 | 0.002 | — | — | — | | | | | |
| 17 | | | | | | | | | 800° C. × 2 minutes | — | " | 3.61 | 1.78 |
| 18 | | | | | | | | | 800° C. × 2 minutes | 6% | " | 3.03 | 1.76 |

The table shows the annealing condition of the hot-rolled strips, the stress-relief annealing condition, and the watt loss ($W_{15/50}$) and the magnetic flux density ($B_{50}$) of the non-oriented electrical steel sheets. The watt loss ($W_{15/50}$) and magnetic flux density ($B_{50}$) were measured after stress-relief annealing.

The silicon content and the manganese content of steel No. 1 were higher and lower, than those of the present invention. Steel No. 1 therefore corresponds, to a conventional high-grade semi-processed non-oriented electrical steel sheet in which, due to the high silicon content, the watt loss is low but the magnetic flux density is also disadvantageously low, as explained hereinabove.

The manganese content of Steel No. 2 is lower than that of the present invention. Steel Nos. 3 through 18 are examples of the present invention. Steel Nos. 7 through 10 contain from 0.1% to 0.3% aluminum, Steel Nos. 11 through 14 contain less than 0.1% aluminum and 0.7 to 1.2 times as much nitrogen as boron from 0.05% to 0.15% phosphorus.

As can be seen from the table, the semi-processed non-oriented electrical steel sheet of the present invention is superior to conventional high-grade products, in which a large amount of a resistivity-increasing element, such as silicon, is employed for reducing the watt loss since in the case of such an element, the watt loss is reduced without the magnetic flux density being reduced and with the magnetic flux density even being increased occasionally.

We claim:

1. A process for producing a semi-processed non-oriented electrical steel sheet having a low watt loss, and a high magnetic flux density which consists essentially of the steps of:

forming a hot-rolled steel strip consisting of in weight percent, not more than 0.005% carbon, from 0.1% to 1.0% silicon, and from 0.75% to 1.5% manganese, the balance being iron unavoidable impurities, including 0.005% sulfur at the highest;

annealing said hot-rolled steel strip at a temperature of from 750° C. to 850° C. for at least 2 minutes;

subjecting said hot rolled steel strip to pickling after annealing; and subjecting the pickled steel strip to either single cold-rolling or to cold rolling followed by intermediate annealing and skin pass rolling whereby the steel sheet having a final thickness is obtained.

2. The process for producing a semi-processed non-oriented electrical steel sheet having a low watt loss and a high magnetic flux density which consists essentially of the steps of:

forming a hot-rolled steel strip consisting of, in weight percent, not more than 0.005% carbon, from 0.1% to 1.0% silicon, from 0.75% to 1.5% of manganese, from 0.1% to 0.3% aluminum, the balance being iron and unavoidable impurities, including 0.005% sulfur at the highest;

annealing said hot-rolled steel strip at a temperature of from 750° C. to 850° C. for at least 2 minutes;

subjecting said hot-rolled steel strip to pickling after annealing; and subjecting the pickled steel strip to either single cold-rolling or to cold-rolling followed by intermediate annealing and skin pass rolling, whereby the steel sheet is obtained.

3. A process for producing a semi-processed non-oriented electrical steel sheet having a low watt loss and a high magnetic flux density which consist essentially of the steps of:

forming a hot-rolled steel strip consisting of, in weight percent, not more than 0.005% carbon, from 0.1% to 1.0% silicon, from 0.75% to 1.5% manganese, and less than 0.1% aluminum, boron and nitrogen wherein there is 0.7 to 1.2 times as much nitrogen as boron, the balance being iron and unavoidable impurities, including 0.005% sulfur at the highest;

annealing said hot-rolled steel strip at a temperature of from 750° C. to 850° C. for at least 2 minutes, subjecting said hot-rolled steel strip to pickling after annealing; and subjecting the pickled steel strip to either single cold-rolling or to cold-rolling followed by intermediate annealing and skin pass rolling, whereby the steel sheet is obtained.

4. The process for producing a semi-processed non-oriented electrical steel sheet having a low watt loss and a high magnetic flux density which consists essentially of the steps of:

forming a hot-rolled steel strip consisting of, in weight percent, not more than 0.005% carbon, from 0.1% to 1.0% silicon, from 0.75% to 1.5% manganese, from 0.05% to 0.15% phosphorus, the balance being iron and unavoidable impurities, including 0.005% sulphur at the highest;

annealing said hot-rolled steel strip at a temperature of from 750° C. to 850° C. for at least 2 minutes;

subjecting said hot-rolled steel strip to pickling after said annealing; and subjecting the pickled steel strip to either single cold-rolling or to cold-rolling followed by intermediate annealing and skin pass rolling, whereby the steel sheet is obtained.

5. The process for producing a semi-processed non-oriented electrical steel sheet having a low watt loss and a high magnetic flux density which consists essentially of the steps of:

forming a hot-rolled steeled strip consisting of, in weight percent, not more than 0.005% carbon, from 0.1% to 1.0% silicon, from 0.75% to 1.5% manganese, from 0.05% to 0.15% phosphorus, from 0.1% to 0.3% aluminum, the balance being iron and unavoidable impurities, including 0.005% sulphur at the highest;

annealing said hot-rolled steel strip at a temperature of from 750° C. to 850° C. for at least 2 minutes;

subjecting said hot-rolled steel strip to pickling after said annealing; and subjecting the pickled steel strip to either single cold-rolling or to cold-rolling followed by intermediate annealing and skin pass rolling, whereby the steel sheet is obtained.

6. The process for producing a semi-processed non-oriented electrical steel sheet having a low watt loss and a high magnetic flux density which consists essentially of the steps of:

forming a hot-rolled steeled strip consisting of, in weight percent, not more than 0.005% carbon, from 0.1% to 1.0% silicon, from 0.75% to 1.5% manganese, from 0.05% to 0.15% phosphorus, from 0.1% to 0.3% aluminum, boron and nitrogen wherein the amount of nitrogen is 0.7 to 1.2 times as much as boron, the balance being iron and unavoidable impurities, including 0.005% sulphur at the highest;

annealing said hot-rolled steel strip at a temperature of from 750° C. to 850° C. for at least 2 minutes;

subjecting said hot-rolled steel strip to pickling after said annealing; and subjecting the pickled steel strip to either single cold-rolling or to cold-rolling followed by intermediate annealing and skin pass rolling, whereby the steel sheet is obtained.

* * * * *